United States Patent [19]

Galber

[11] Patent Number: 4,915,291

[45] Date of Patent: Apr. 10, 1990

[54] PACKAGING MODULAR ENVELOPE INCLUDING SELF-SEALING CLOSURE MEANS

[76] Inventor: Maria A. Galber, Via Biancamano, 14, 20052 Monza (Milano), Italy

[21] Appl. No.: 201,535

[22] Filed: Jun. 2, 1988

[30] Foreign Application Priority Data

Jun. 4, 1987 [IT] Italy ..... 20796 A/87

[51] Int. Cl.[4] ..... B65D 5/32

[52] U.S. Cl. ..... 229/125.26; 229/23 BT

[58] Field of Search ..... 229/23 R, 23 BT, 175, 229/125.26, DIG. 4

[56] References Cited

U.S. PATENT DOCUMENTS

| | | | |
|---|---|---|---|
| 695,205 | 3/1902 | Goodnow | 229/175 |
| 1,473,432 | 11/1923 | Huye | 229/125.26 |
| 1,771,760 | 7/1930 | MacLellan | 229/DIG. 4 |
| 2,580,586 | 1/1952 | O'Reilly | 229/125.26 |
| 2,734,676 | 2/1956 | Lawrence | 229/23 R |
| 2,800,266 | 7/1957 | Kelly | 229/125.26 |
| 2,887,264 | 5/1959 | Fallert | 229/125.26 |
| 2,902,202 | 9/1959 | Fallert | 229/23 R |
| 2,983,423 | 5/1961 | Vail | 229/125.26 |
| 3,286,901 | 11/1966 | Anderson | 229/23 BT |
| 4,531,669 | 7/1985 | Osborne | 229/125.26 |

*Primary Examiner*—Gary Elkins

*Attorney, Agent, or Firm*—Bucknam and Archer

[57] ABSTRACT

The envelope essentially comprises a tubular body (1), of given cross-section, provided with outwardly turned edges (2).

With the tubular body (1) two box-like bodies (3,3') cooperate, having mating cross-sections, and provided with inwardly turned edges (4) and adapted to operate as closure covers for the tubular body (1).

3 Claims, 2 Drawing Sheets

PACKAGING MODULAR ENVELOPE INCLUDING SELF-SEALING CLOSURE MEANS

BACKGROUND OF THE INVENTION

The present invention relates to a modular envelope, for packaging purposes, which is provided with a self-sealing type of closure system.

As is known, several types of containers are presently available on the market which have been specifically designed for packaging given products.

These known containers must be closed in a firm way, or tight manner, in orderly to properly preserve the contained products.

Also known is the fact that some waste products, such as hospital wastes and the like, must be packaged in accurately and firmly sealed containers in order to prevent said wastes from leaking off the container.

The closure operations of these containers, on the other hand, require a lot of time and labour.

SUMMARY OF THE INVENTION

Accordingly, the task of the present invention is to overcome the above mentioned drawback by providing such a packaging envelope structure which is of the self-sealing type, and adapted to provide a container which, after closure, can not be opened without mutilation readily discernible at glance.

Within the scope of the above mentioned task a main object of the present invention is to provide such a packaging envelope which is structurally very simple and can be used in a very easy way.

Another object of the present invention is to provide such an envelope which affords the possibility of forming very reliable and safe containers.

According to one aspect of the present invention, the above task and objects, as well as yet other objects, which will become more apparent hereinafter, are achieved by a self-sealing packaging envelope, characterized in that it essentially comprises a tubular body, of given cross-section, provided with outwardly turned edges, therewith two box-like bodies cooperate, said box-like bodies having related crosssections and being provided with inwardly turned edges and adapted to operate as closure covers for said tubular body.

BRIEF DESCRIPTION OF THE DRAWINGS

Further characteristics and advantages of the packaging envelope according to the present invention will become more apparent hereinafter from the following detailed description of a preferred embodiment thereof, being illustrated, by way of an indicative but not limitative example, in the figures of the accompanying drawings, where.

DESCRIPTION OF THE PREFERRED EMBODIMENT

Figure 1:
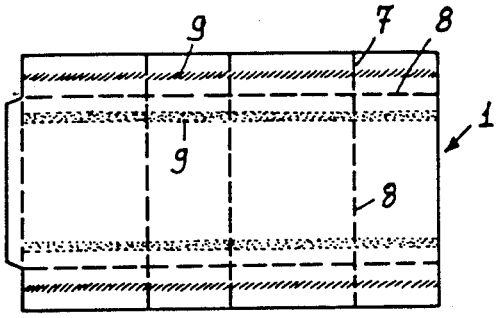
FIG. 1 is an extended plan view of the tubular body of the packaging envelope according to the present invention.
Figure 2:
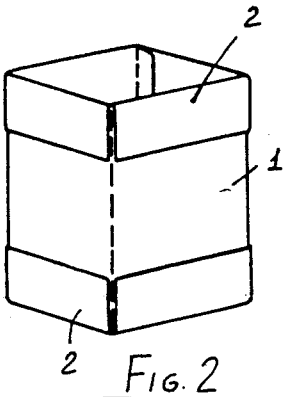
FIGS. 2 and 3 are respectively a perspective view and an elevation view of that same tubular body.
Figure 3:
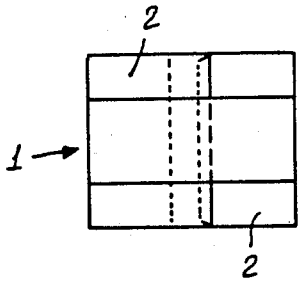

With reference to the figures of the accompanying drawings, the packaging envelope structure according to the present invention comprises a tubular body 1 having preferably a regular polygonal cross-section and having outwardly turned edges 2 of suitable height.

With this tubular body 1, two open box-like bodies 3 and 3', or top and bottom covers, cooperate which have a shape mating with to the cross-section of the tubular body.

The box-like bodies 3 and 3', in turn, are provided with inwardly turned edges 4 which are adapted to engage at the free perimetrical line 5 with the free perimetrical line 6 of the upturned portions of the tubular body.

Figure 8:
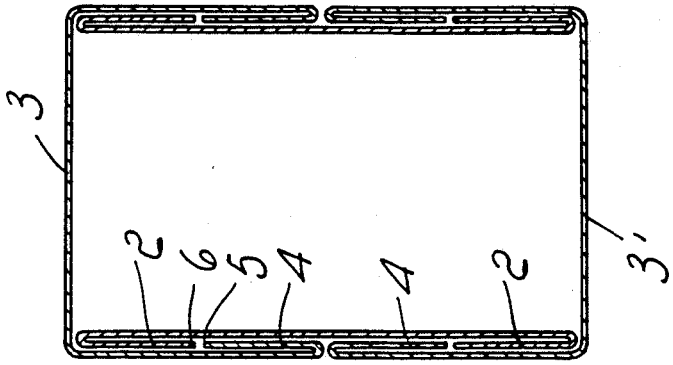
FIG. 8 shows a vertical cross-sectional view of the packaging envelope according to the present invention.
Figure 7:
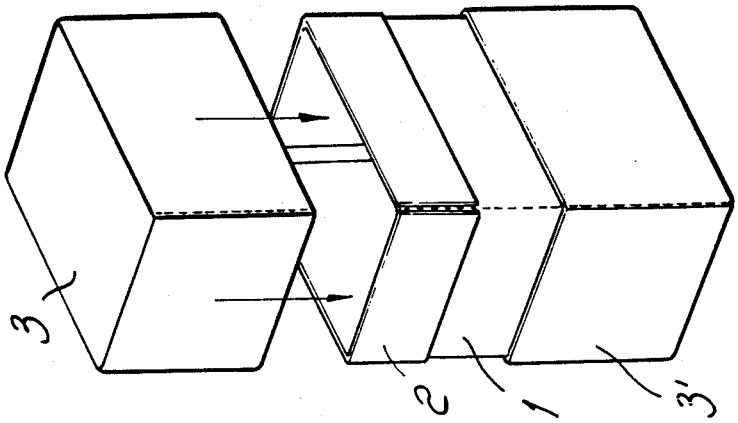
FIG. 7 shows the procedure for coupling the above mentioned component elements.

Thus the single box-like bodies, as they are threaded, by a suitable pressure, onto the tubular body will be firmly locked thereon, thereby providing a fixed coupling, as clearly shown in FIG. 8.

As shown clearly in FIG. 8, the sum of the heights of the edges 2 and edges 4 is substantially equal to a half of the height of the tubular body 1, so that the edges 2 and 4, in the envelope configuration shown in FIG. 8, will fully encompass the tubular body 1 sheet material to properly protect it against possible outer impacts. Moreever, as a further feature of the invention, as a filled envelope is stacked on a like envelope, the edges 2 and 4 will abut against one another so as to provide a great stacking resistance.

The mentioned tubular body and box-like bodies can be made starting from any suitable materials, depending on the provided use for the container to be formed thereby.

For example impermeable materials can be used so as to form tight containers for packaging grains, powders, liquids and so on.

In this connection it should be pointed out that the packaging envelope according to the invention can be advantageously used for hospital waste materials and/or elements, such as syringes, used boxes, towels and the like.

In fact the subject envelope, after closure, can not be opened unless at least one of its covers is forcibly and destructively removed.

Figure 4:
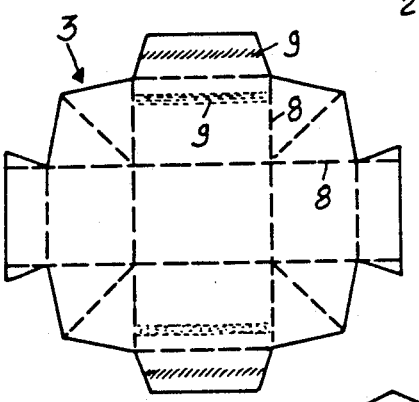
FIGS. 4 and 5 represent the extended box-like body provided with two bent side flaps.
Figure 5:
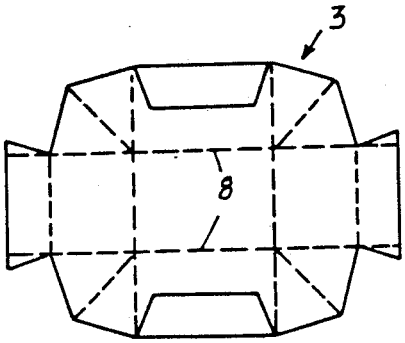
Figure 6:
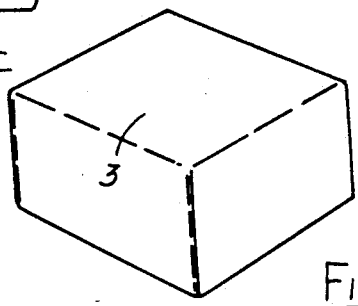
FIG. 6 is a perspective view of the boxlike body.
Figure 9:
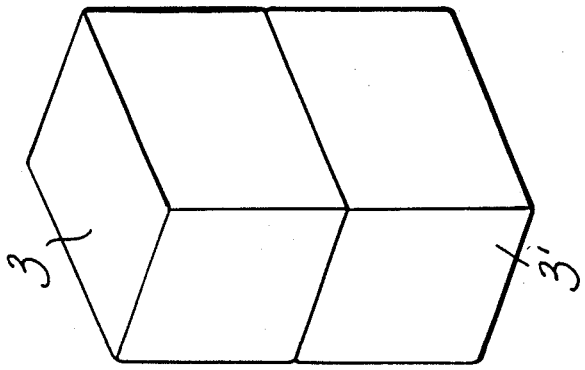
FIG. 9 shows a perspective view of the packaging envelope.

Advantageously there is provided to store and sell the tubular body 1 and box-like bodies 3 in a flat extended configuration (as shown in figures 1 and 4) so as to have a minimum size in their not use condition.

In actual practice the tubular and box-like bodies are made starting from sheet material having suitable die cut lines 7 and ribbed lines (8).

Adhesive strips 9 can be moreover provided for facilitating the coupling of the upturned edges on the corresponding walls of said bodies.

In this connection it should be apparent that the exposed walls of the subject container can bear printed matter and moreover the formed container can be provided with holding handles and the like.

From the above disclosure and from the figures of the accompanying drawings the great advantages of the packaging envelope according to the present invention will be self-evident.

While the invention has been disclosed and illustrated with reference to a preferred embodiment thereof, it should be apparent that the disclosed embodiment is susceptible to several modifications and variations all of which will come within its spirit and scope.

I claim:

1. A self-sealing packaging envelope comprising a tubular body of given polygonal cross-section and height, provided with outwardly turned edges having a first height, therewith two top and bottom cover bodies cooperate having mating cross-sections and being provided with inwardly turned edges having a second height, wherein said first and second height sum substantially corresponds to a half of said tubular body height, and wherein said tubular body and cover bodies are made by folding along die cut lines a respective tubular body sheet materials and a respective cover body sheet material.

2. A self-sealing packaging envelope according to claim 1 wherein said outwardly turned edges and said inwardly turned edges are slightly spaced from said tubular body and cover bodies respectively.

3. A self-sealing packaging envelope according to claim 1, wherein said outwardly turned edges and said inwardly turned edges are rigidly coupled to said tubular body and cover bodies by an adhesive material.

* * * * *